US011913672B2

(12) United States Patent
Vasudevan

(10) Patent No.: US 11,913,672 B2
(45) Date of Patent: Feb. 27, 2024

(54) HEATING, VENTILATION, AND AIR-CONDITIONING SYSTEM WITH DEHUMIDIFICATION

(71) Applicant: Goodman Global Group, Inc, Waller, TX (US)

(72) Inventor: Geethakrishnan Vasudevan, Sugarland, TX (US)

(73) Assignee: Goodman Global Group, Inc., Waller, TX (US)

( * ) Notice: Subject to any disclaimer, the term of this patent is extended or adjusted under 35 U.S.C. 154(b) by 91 days.

(21) Appl. No.: 17/128,902

(22) Filed: Dec. 21, 2020

(65) Prior Publication Data

US 2022/0196262 A1 Jun. 23, 2022

(51) Int. Cl.
*F24F 3/14* (2006.01)
*F24F 3/153* (2006.01)
(Continued)

(52) U.S. Cl.
CPC ..... *F24F 3/1405* (2013.01); *F24F 3/14* (2013.01); *F24F 3/153* (2013.01);
(Continued)

(58) Field of Classification Search
CPC .. F24F 3/1405; F24F 3/14; F24F 3/153; F24F 2003/1452; F24F 2110/20; F24F 2140/30;
(Continued)

(56) References Cited

U.S. PATENT DOCUMENTS 5,992,160 A * 11/1999 Bussjager et al. ..... F24F 3/153 62/79
10,488,071 B2 11/2019 Fradkin
(Continued)

FOREIGN PATENT DOCUMENTS

| | | | |
|---|---|---|---|
| JP | 11137948 | A | 5/1999 |
| JP | 2015152266 | A | 8/2015 |
| WO | 2015182463 | A1 | 12/2015 |

OTHER PUBLICATIONS

International Search Report and Written Opinion dated Mar. 4, 2022 for corresponding PCT Application No. PCT/US2021/059516 filed Nov. 16, 2021.

*Primary Examiner* — Elizabeth J Martin
*Assistant Examiner* — Dario Antonio Deleon
(74) *Attorney, Agent, or Firm* — K&L Gates LLP

(57) ABSTRACT

A dehumidification system for use with a dehumidification refrigerant to dry ambient air as part of a heating, ventilation, and air-conditioning ("HVAC") system that includes an HVAC condenser as part of an HVAC refrigeration circuit. The dehumidification system may include a dehumidification refrigeration circuit separate from the HVAC refrigeration circuit. The dehumidification circuit may include a dehumidification compressor, a dehumidification condenser, a dehumidification expansion device, and a dehumidification evaporator. The dehumidification condenser may be positioned in close proximity to the HVAC condenser such that airflow across the HVAC condenser also flows across the dehumidification condenser. The dehumidification evaporator may be spaced apart from the dehumidification condenser such that airflow across the dehumidification evaporator does not flow across the dehumidification condenser.

20 Claims, 3 Drawing Sheets

(51) Int. Cl.
*F24F 140/30* (2018.01)
*F24F 110/20* (2018.01)

(52) U.S. Cl.
CPC ... *F24F 2003/1452* (2013.01); *F24F 2110/20* (2018.01); *F24F 2140/30* (2018.01)

(58) Field of Classification Search
CPC .. F24F 1/0035; F24F 2110/10; F24F 2110/12; F24F 2110/22; F25B 6/02
See application file for complete search history.

(56) References Cited

U.S. PATENT DOCUMENTS

| | | | | |
|---|---|---|---|---|
| 2003/0121271 | A1* | 7/2003 | Dinnage et al. | F25D 17/06 62/94 |
| 2008/0202155 | A1* | 8/2008 | Taras et al. | F24F 3/153 62/498 |
| 2010/0257884 | A1* | 10/2010 | Matsui | F25B 15/02 62/271 |
| 2018/0128506 | A1* | 5/2018 | Taras et al. | F24F 5/00 |
| 2019/0203954 | A1 | 7/2019 | Zhou | |
| 2019/0226736 | A1* | 7/2019 | Walser | F25B 49/02 |
| 2020/0124299 | A1* | 4/2020 | Sugitani et al. | F24F 3/14 |
| 2020/0309394 | A1* | 10/2020 | Blanton | F24F 3/153 |
| 2020/0332166 | A1* | 10/2020 | Kumakura et al. | F25B 41/00 |
| 2021/0316597 | A1* | 10/2021 | Okamura | F25B 6/02 |
| 2022/0178559 | A1* | 6/2022 | Schaefer et al. | F24F 3/1405 |

* cited by examiner

HEATING, VENTILATION, AND AIR-CONDITIONING SYSTEM WITH DEHUMIDIFICATION

BACKGROUND

This section is intended to introduce the reader to various aspects of the art that may be related to various aspects of the presently described embodiments—to help facilitate a better understanding of various aspects of the present embodiments. Accordingly, it should be understood that these statements are to be read in this light, and not as admissions of prior art.

In general, heating, ventilation, and air-conditioning ("HVAC") systems circulate an indoor space's air over low-temperature (for cooling) or high-temperature (for heating) sources, thereby adjusting an indoor space's ambient air temperature. HVAC systems generate these low- and high-temperature sources by, among other techniques, taking advantage of a well-known physical principle: a fluid transitioning from gas to liquid releases heat, while a fluid transitioning from liquid to gas absorbs heat.

Within a typical HVAC system, a fluid refrigerant circulates through a closed loop refrigeration circuit of tubing that uses a compressor and flow-control devices to manipulate the refrigerant's flow and pressure, causing the refrigerant to cycle between the liquid and gas phases. Generally, these phase transitions occur within the HVAC system heat exchangers, which are part of the closed loop circuit and designed to transfer heat between the circulating refrigerant and flowing ambient air. As would be expected, the heat exchanger interacting with the climate-controlled space or structure is described adjectivally as being "indoors," and the heat exchanger interacting with the surrounding outdoor environment is described as being "outdoors."

The refrigerant circulating between the indoor and outdoor heat exchangers absorbs heat from one location and releases it to the other. Those in the HVAC industry describe this cycle of absorbing and releasing heat as "pumping." To cool the climate-controlled indoor space, heat is "pumped" from the indoor side to the outdoor side, and the indoor space is heated by doing the opposite, pumping heat from the outdoors to the indoors.

Additionally, in some situations it is desirable to remove moisture from the indoor environment. Further, some HVAC systems, such as packaged terminal HVAC ("PTAC") systems, are required to introduce outdoor air into a climate-controlled space and the outdoor air occasionally needs to be dehumidified. In such situations, a dehumidification system on a separate dehumidification refrigeration circuit from the HVAC circuit is typically utilized as part of the HVAC system. However, traditional dehumidification systems place the condenser and the evaporator close together, or "stacked". This configuration reduces the efficiency of the dehumidification evaporator because the air passing through the dehumidification system is heated by the condenser prior to entering the indoor space. Thus, the dehumidification evaporator must absorb heat from the air itself as well as heat given off from the dehumidification condenser. Further, only low-pressure refrigerants (refrigerants that are designed to operate at 250 psi or less) can be used in the dehumidification systems due to the relatively small sizes of the dehumidification heat exchangers and the fan that flows air through the heat exchangers.

SUMMARY

Embodiments of the invention disclosed herein are set forth below. It should be understood that these embodiments are presented merely to provide the reader with a brief summary of certain forms the invention might take and that these embodiments are not intended to limit the scope of the invention. Indeed, the invention may encompass a variety of aspects that may not be set forth below.

Embodiments of the present disclosure generally relate to an HVAC system that includes a dehumidification system.

Utilizing a dehumidification condenser on a dehumidification refrigeration circuit that is coupled to or positioned in close proximity to a condenser of an HVAC refrigeration circuit of an HVAC system allows a single high-airflow fan to flow air across both condensers. This allows a high-pressure refrigerant (i.e., a refrigerant designed to operate at 400 psi or more) to be used within the dehumidification system. Additionally, positioning the dehumidification condenser separately from a dehumidification evaporator prevents heat from the dehumidification evaporator being added to outdoor air that is dried via the dehumidification system Various refinements of the features noted above may exist in relation to various aspects of the present embodiments. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. Again, the brief summary presented above is intended only to familiarize the reader with certain aspects and contexts of some embodiments without limitation to the claimed subject matter.

BRIEF DESCRIPTION OF THE DRAWINGS

Embodiments of the dehumidification system and the associated HVAC system are described with reference to the following figures. These and other features, aspects, and advantages of certain embodiments will become better understood when the following detailed description is read with reference to the accompanying drawings in which like characters represent like parts throughout the drawings, wherein.

DETAILED DESCRIPTION

One or more specific embodiments of the present disclosure will be described below. In an effort to provide a concise description of these embodiments, not all features of an actual implementation may be described. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Figure 1:
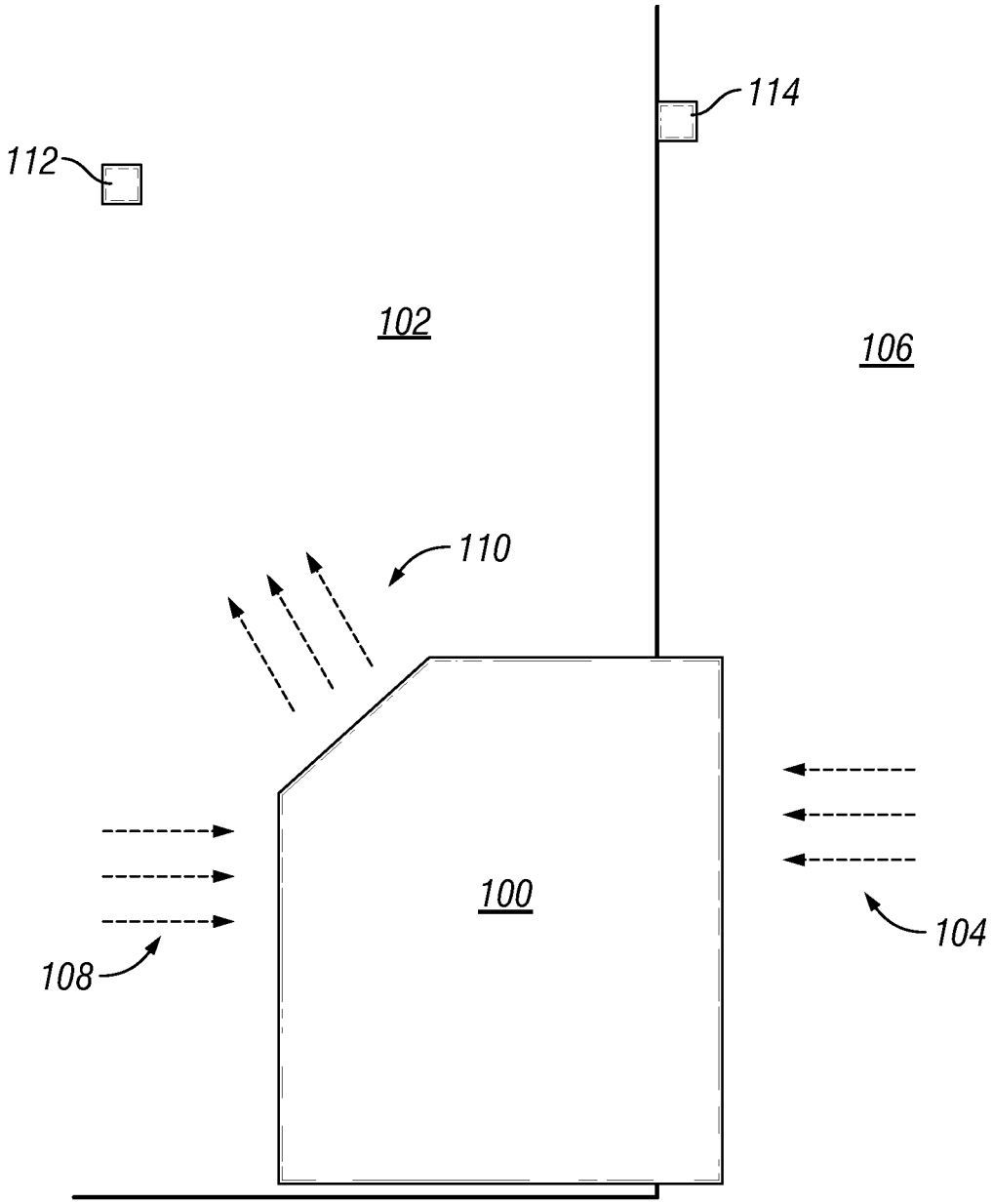
FIG. 1 is a simplified illustration of a packaged terminal type HVAC system.

Turning now the figures, FIG. 1 is a simplified schematic illustration of a packaged terminal type HVAC ("PTAC") system 100 that includes a dehumidification system, in accordance with an embodiment. The HVAC system 100 heats and cools a climate-controlled space 102 and introduces air 104 from the outdoor environment 106 into the climate-controlled space 102. The HVAC system 100 may also reduce the amount of water vapor (i.e., dry the outdoor air 104) prior to introducing the outdoor air 104 into the climate-controlled space 102. However, the concepts disclosed herein are applicable to numerous of heating and cooling situations, which include industrial and commercial settings.

To heat or cool the climate-controlled space 102, the HVAC system 100 passes air 108 from the climate-controlled space 102 over one or more heating/cooling elements (i.e., sources of heating or cooling), and then reintroduces that conditioned air 110, whether heated or cooled, back into climate-controlled space 102. A blower (not shown) provides the motivational force to circulate the air 108 from the climate-controlled space 102 through the HVAC system 100. Additionally, although a packaged terminal type HVAC system is shown in FIG. 1, the disclosed embodiments can be equally applied to the split or other types of system configurations.

The HVAC system 100 manipulates the pressure and flow of refrigerants circulating within the HVAC system 100 to cool the climate-controlled space 102 and/or to reduce the humidity of the climate-controlled space by introducing dried outdoor air 104 (as described in more detail below with reference to FIG. 2). The HVAC system 100 also includes an electric heating element within the HVAC system 100 to heat the air being reintroduced into the climate-controlled space 102. The HVAC system 100 may alternatively or also manipulate the pressure and flow of the refrigerant circulating within the HVAC system 100 to heat the climate-controlled space 102.

The HVAC system 100 also includes a control system (not shown) that is in electronic communication with and controls the operation of various components of the HVAC system 100, as described in more detail below. The control system adjusts the operation of these components based on the required heating or cooling that must be provided by the HVAC system 100 and the humidity within the climate-controlled space 102.

In at least one embodiment, the control system is in electronic communication with one or more sensors 112, shown in FIG. 1, that measure the temperature and/or humidity within the climate-controlled space 102 and, optionally, an additional sensor or sensors 114 that measure the temperature and/or humidity of the outdoor environment 106, to determine if the dehumidification system should operate. The control system may operate the dehumidification system based on user input from an input device as described below, such as a desired humidity within the climate-controlled space 102.

Figure 2:
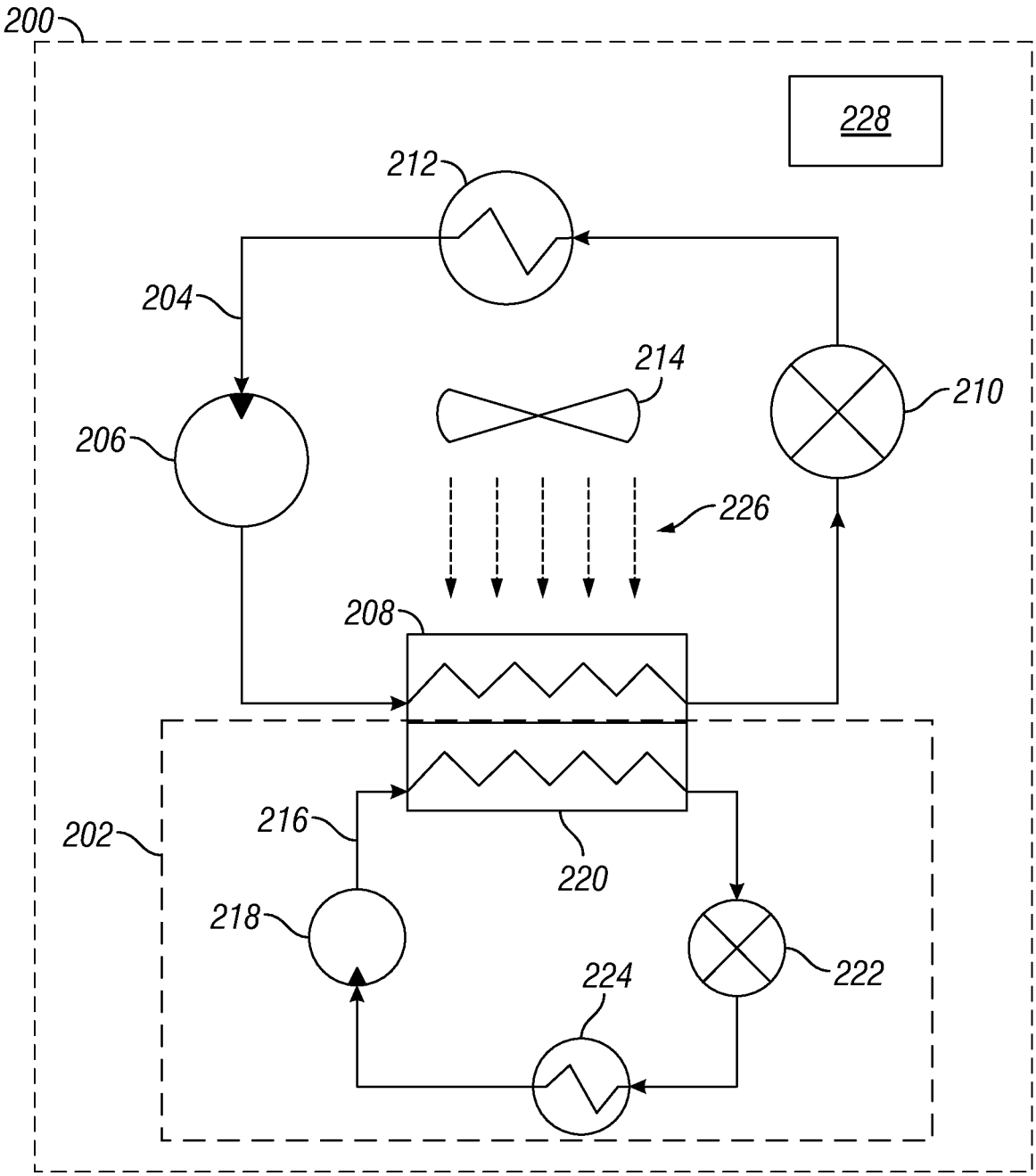
FIG. 2 is a simplified block diagram of an HVAC system, according to one or more embodiments.

Referring now to FIG. 2, FIG. 2 is a simplified block diagram of an HVAC system 200 operating as an air conditioner and that includes a dehumidification system 202 that dries ambient air. The HVAC system 200 includes an HVAC refrigeration circuit 204 that includes an HVAC compressor 206, a first HVAC heat exchanger 208, an HVAC expansion device 210, a second HVAC heat exchanger 212, and HVAC fan 214. Further, an HVAC refrigerant circulates through the HVAC compressor 206, the first HVAC heat exchanger 208, the HVAC expansion device 210, and the second HVAC heat exchanger 212. Similarly, the dehumidification system 202 of the HVAC system 200 includes a dehumidification refrigerant circuit 216 that includes a dehumidification compressor 218, a first dehumidification heat exchanger 220, a dehumidification expansion device 222, and second dehumidification heat exchanger 224, and a dehumidification refrigerant circulates through the dehumidification refrigeration circuit 216. As shown in FIG. 2, the HVAC refrigeration circuit 204 is separate from the dehumidification refrigeration circuit 216.

As discussed above, the first HVAC heat exchanger and the first dehumidification heat exchanger 220 are coupled together or positioned in close proximity to each other such that the single HVAC fan 214 can flow air 226 over both the HVAC and the dehumidification heat exchangers 208, 220. Further, the first dehumidification heat exchanger 220 and the second dehumidification heat exchanger 224 are spaced apart such that airflow across the second dehumidification heat exchanger 224 does not flow across the first dehumidification heat exchanger 220 and thus heat from the second dehumidification heat exchanger 224 does not affect the efficiency of the first dehumidification heat exchanger 220.

When the HVAC system 200 is operating as an air conditioner, the first HVAC heat exchanger 208 operates as a condenser, aiding transition of the HVAC refrigerant from a high-pressure gas to a high-pressure liquid and releasing heat to the outdoor environment in the process. When the HVAC system 200 is operating as a heat pump, the first HVAC heat exchanger 208 operates as an evaporator, aiding transition of the HVAC refrigerant from a low-pressure liquid to a low-pressure gas, thereby absorbing heat from the outdoor environment.

Whatever the state of the first HVAC heat exchanger 208 (i.e., absorbing or releasing heat), the second HVAC heat exchanger 212 is in the opposite state. More specifically, if cooling is desired, the second HVAC heat exchanger 212 operates as an evaporator and the first HVAC heat exchanger 208 operates as a condenser. If heating is desired, the flow of refrigerant within the HVAC system 200 is reversed via flow control devices (not shown), allowing the second HVAC heat exchanger 212 to operate as a condenser and allowing the first HVAC heat exchanger 208 to act as an evaporator. In both cases, the HVAC expansion device 210 expands high-pressure liquid refrigerant from the condenser into low-pressure two-phase mixture refrigerant, which then flows into the evaporator.

When the HVAC system 200 is operating as an air conditioner and when dehumidification of outdoor air being introduced into the climate-controlled space is desired, the first dehumidification heat exchanger 220 operates as a condenser and the second dehumidification heat exchanger 224 operates as an evaporator. Outdoor air is flowed over the second dehumidification heat exchanger 224 to evaporate the dehumidification refrigerant therein, which cools the outdoor air that then enters the climate-controlled spaces.

Cooling the outdoor air results in a reduction of humidity within the outdoor air flowing over the second dehumidification heat exchanger 224, resulting in dried outdoor air being introduced into the climate-controlled space. Since the second dehumidification heat exchanger 224 is spaced apart from first dehumidification heat exchanger 220, the dried outdoor air is not flowed over the first dehumidification heat exchanger 220 and, thus, is not heated prior to being introduced into the climate-controlled space. Therefore, the dehumidification system 202, specifically the dehumidification condenser, does not add any sensible load to the climate-controlled space. Further, additional outdoor air can be flowed through the dehumidification system since there is not additional impedance to the airflow due to the physical presence of the first dehumidification heat exchanger 220 close to the second dehumidification heat exchanger, blocking airflow.

The HVAC compressor 206 receives low-pressure gas HVAC refrigerant from either the second HVAC heat exchanger 212 if cooling is desired or from the first HVAC heat exchanger 208 if heating is desired. The dehumidification compressor 218 receives low-pressure gas refrigerant from the second dehumidification heat exchanger 224 if dehumidification of outdoor air is desired. The HVAC compressor 206 and the dehumidification compressor 218 compress the respective gas refrigerants to a higher pressure based on a compressor volume ratio, namely the ratio of a discharge volume, the volume of gas outputted from the compressor 206, 218 once compressed, to a suction volume, the volume of gas inputted into the compressor 206, 218 before compression, and other operating conditions. In at least one embodiment, the HVAC compressor 206 is a multi-stage compressor that can transition between at least two volume ratios depending on whether heating or cooling is desired.

In at least one embodiment, the HVAC refrigerant and the dehumidification refrigerant are the same type of refrigerant (e.g., both refrigerants are R-32 or R-134a). This reduces the number of refrigerants a technician must carry when servicing HVAC systems. Further, using the large HVAC fan 214 to flow air across the first HVAC heat exchanger 208 and the first dehumidification heat exchanger 220 allows a high-pressure refrigerant (i.e., a refrigerant designed to operate at 400 psi or more), such as R-32, to be used in the dehumidification system 202 since the high airflow across the first dehumidification heat exchanger 220 removes sufficient heat from the dehumidification refrigerant.

The HVAC system 200 also includes a control system 228 in electronic communication with at least the compressors 206, 218 and various sensors, such as temperature sensors and humidity sensors, positioned throughout the HVAC system and/or within the climate-controlled space. The control system 228 operates the HVAC compressor 206, the dehumidification compressor 218, or both compressors 206, 218 to reach and/or maintain a desired temperature and humidity within the climate-controlled space, which are determined as discussed above with reference to FIG. 1. Further, the control system 228 may operate the flow control devices to transition the HVAC system 200 between operating as an air conditioner and operating as a heat pump.

Figure 3:
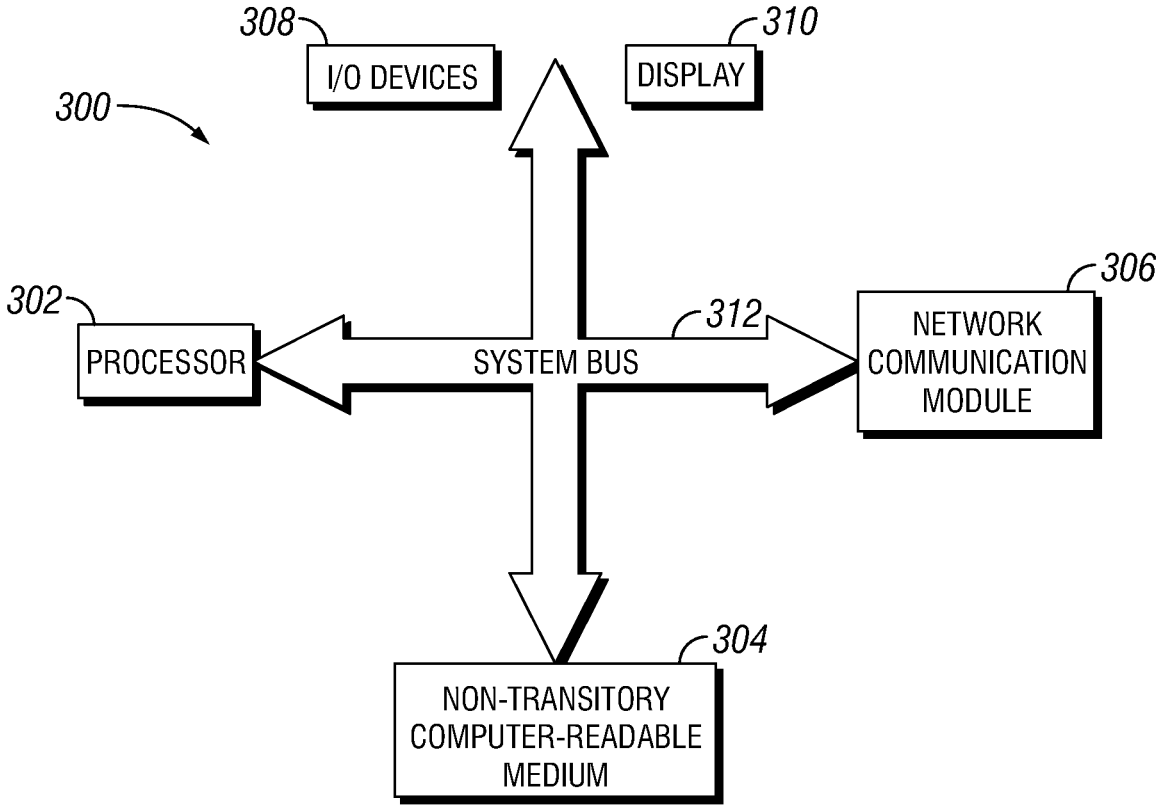
FIG. 3 is a block diagram of a controller, according to one or more embodiments.

Turning now to FIG. 3, FIG. 3 is a block diagram of a control system 300 that can be used to control an HVAC system, such as those as described above with reference to FIGS. 1 and 2. The control system 300 includes at least one processor 302, a non-transitory computer readable medium 304, an optional network communication module 306, optional input/output devices 308, and an optional display 310 all interconnected via a system bus 312. In at least one embodiment, the input/output device 308 and the display 310 may be combined into a single device, such as a touch-screen display. Further, the display 310 may also include a temperature sensor that monitors the temperature within a structure. Software instructions executable by the processor 302 for implementing software instructions stored within the control system 300 in accordance with the illustrative embodiments described herein, may be stored in the non-transitory computer readable medium 304 or some other non-transitory computer-readable medium.

Although not explicitly shown in FIG. 3, it will be recognized that the control system 300 may be connected to one or more public and/or private networks via appropriate network connections. It will also be recognized that software instructions may also be loaded into the non-transitory computer readable medium 304 from an appropriate storage media or via wired or wireless means.

While the aspects of the present disclosure may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims. For example, certain embodiments disclosed here envisage usage with a powered fan rather than an inducer fan, or no fan at all. Moreover, the rotating equipment (e.g., motors) and valves disclosed herein are envisaged as being operable at specified speeds or variable speeds through inverter circuitry, for example. Moreover, the internal and external communication of the furnace may be accomplished through wired and or wireless communications, including known communication protocols, Wi-Fi, 802.11(x), Bluetooth, to name just a few.

What is claimed is:

1. A dehumidification system for use with a dehumidification refrigerant to dry ambient air as part of a heating, ventilation, and air-conditioning ("HVAC") system for a climate-controlled space, the HVAC system including an HVAC condenser as part of an HVAC refrigeration circuit, the dehumidification system comprising a dehumidification refrigeration circuit separate from the HVAC refrigeration circuit, the dehumidification refrigeration circuit comprising:

a dehumidification compressor;

a dehumidification condenser positioned in proximity to the HVAC condenser such that airflow across the HVAC condenser also flows across the dehumidification condenser;

a dehumidification expansion device; and a dehumidification evaporator spaced apart from the dehumidification condenser such that airflow across the dehumidification evaporator does not flow across the dehumidification condenser;

wherein airflow across the dehumidification evaporator is dried by the dehumidification evaporator and then introduced into the climate-controlled space.

2. The dehumidification system of claim 1, wherein a fan of the HVAC system flows air across the HVAC condenser and the dehumidification condenser.

3. The dehumidification system of claim 1, wherein the dehumidification refrigerant is the same refrigerant as a refrigerant used in the HVAC refrigeration circuit.

4. The dehumidification system of claim 1, wherein the dehumidification refrigerant is a high-pressure refrigerant.

5. The dehumidification system of claim 1, wherein air dried via the dehumidification system is not heated by the dehumidification condenser.

6. An HVAC system for a climate-controlled space, the HVAC system comprising:

an HVAC refrigeration circuit comprising an HVAC compressor, an HVAC condenser, an HVAC expansion device, and an HVAC evaporator; and a dehumidification system operable to dry ambient air and comprising a dehumidification refrigeration circuit separate from the HVAC refrigeration circuit, the dehumidification refrigeration circuit comprising:

a dehumidification compressor;

a dehumidification condenser positioned in proximity to the HVAC condenser such that airflow across the HVAC condenser also flows across the dehumidification condenser;

a dehumidification expansion device; and a dehumidification evaporator spaced apart from the dehumidification condenser such that airflow across the dehumidification evaporator does not flow across the dehumidification condenser;

wherein airflow across the dehumidification evaporator is dried by the dehumidification evaporator and then introduced into the climate-controlled space.

7. The HVAC system of claim 6, further comprising a fan positioned to flow air across the HVAC condenser and the dehumidification condenser.

8. The HVAC system of claim 6, wherein an HVAC refrigerant in the HVAC circuit and a dehumidification refrigerant in the dehumidification refrigeration circuit are the same refrigerant.

9. The HVAC system of claim 6, wherein an HVAC refrigerant in the HVAC circuit and a dehumidification refrigerant in the dehumidification refrigeration circuit are high-pressure refrigerants.

10. The HVAC system of claim 6, further comprising a control system in electronic communication with the HVAC compressor and the dehumidification compressor, the control system programmed to operate the HVAC compressor and the dehumidification compressor.

11. The HVAC system of claim 10, further comprising a sensor in electronic communication with the control system, the sensor operable to measure at least one of temperature or humidity.

12. The HVAC system of claim 11, wherein the control system comprises a processor programmed to operate the HVAC compressor and the dehumidification compressor based on measurements from the sensor.

13. The HVAC system of claim 6, wherein air dried via the dehumidification system is not heated by the dehumidification condenser.

14. A method of operating an HVAC system, the method comprising:

operating a compressor of a dehumidification system comprising a dehumidification refrigeration circuit to compress a dehumidification refrigerant of the dehumidification system;

condensing the refrigerant from the dehumidification compressor with a condenser of the dehumidification system positioned in proximity to a condenser of an HVAC refrigeration circuit separate from the dehumidification refrigeration circuit such that airflow across the HVAC condenser also flows across the dehumidification condenser;

expanding the dehumidification refrigerant from the dehumidification condenser with an expansion device of the dehumidification system;

vaporizing the dehumidification refrigerant from the dehumidification expansion device with an evaporator of the dehumidification system; and flowing air across the dehumidification evaporator to cool and dry the air.

15. The method of claim 14, further comprising introducing the dried air into a climate-controlled space to reduce humidity within the climate-controlled space without adding sensible load to the climate-controlled space from the dehumidification condenser.

16. The method of claim 15, further comprising measuring a humidity of the climate-controlled space via a sensor.

17. The method of claim 16, wherein operating the dehumidification compressor comprises operating the dehumidification compressor based on the measurements from the sensor.

18. The method of claim 14, further comprising flowing air across the dehumidification condenser and the HVAC condenser with a fan of the HVAC system.

19. The method of claim 14, wherein the refrigerant of the dehumidification refrigeration circuit and a refrigerant of the HVAC circuit are the same type of refrigerant.

20. The method of claim 14, wherein refrigerant of the dehumidification refrigeration circuit and a refrigerant of the HVAC circuit are high-pressure refrigerants.

* * * * *